United States Patent [19]

Bystricky

[11] 4,290,058

[45] Sep. 15, 1981

[54] METHOD AND APPARATUS FOR INTRUSION DETECTION BY USING SONIC RECEIVERS

[75] Inventor: Gustav Bystricky, Oberdürnten, Switzerland

[73] Assignee: Cerberus AG, Männedorf, Switzerland

[21] Appl. No.: 91,410

[22] Filed: Nov. 5, 1979

[30] Foreign Application Priority Data

Nov. 30, 1978 [CH] Switzerland ..... 12243/78

[51] Int. Cl.[3] ..... G08B 13/22

[52] U.S. Cl. ..... 340/566; 367/901

[58] Field of Search ..... 367/93, 901; 340/566

[56] References Cited

U.S. PATENT DOCUMENTS

| | | | |
|---|---|---|---|
| 3,134,970 | 5/1964 | Kelly et al. | 340/566 |
| 3,147,467 | 9/1964 | Laakmann | 340/566 |
| 3,471,846 | 10/1969 | Cotter et al. | 367/901 |
| 4,099,168 | 7/1978 | Kedjierski et al. | 340/566 |

*Primary Examiner*—Glen R. Swann, III

*Attorney, Agent, or Firm*—Werner W. Kleeman

[57] ABSTRACT

The oscillations which are generated during an attempted instrusion at a protected area or surface, for instance a vault wall or fence, are received at a sonic receiver and processed by an evaluation circuit such that only the oscillations emanating from an intrusion attempt trip an alarm, not however spurious oscillations from the surroundings. The received oscillations are mixed with a carrier frequency whose frequency periodically and continuously passes through a certain frequency range. The mixed signals are filtered in a narrow band frequency range, so that at the output, during each frequency throughpass period, there appears the entire frequency spectrum of the received sonic oscillations in the evaluated frequency range. The filtered signals are integrated and the integrated signal, after a brief period of time, is reset as a frequency throughpass if no further signal appears. This integrated signal reaches an alarm threshold only upon occurrence of irregular oscillations in the evaluated frequency band, not however in the presence of disturbances due to individual periodic oscillations or spurious oscillations outside of the frequency range.

14 Claims, 2 Drawing Figures

METHOD AND APPARATUS FOR INTRUSION DETECTION BY USING SONIC RECEIVERS

BACKGROUND OF THE INVENTION

The present invention relates to a new and improved method of, and apparatus for, reporting unauthorized intrusions by means of a sonic or acoustical receiver or transducer responsive to sounds transmitted through solids and mounted at a region or surface which is to be protected, there also being provided an electric circuit connected with the sonic receiver for producing a signal when the received sonic oscillations or vibrations exceed predetermined values.

Such systems are used to detect characteristic sonic oscillations or vibrations which are produced when there is attempted an unauthorized intrusion, typically a burglary, for instance by penetrating a wall or concrete structure, upon cutting or welding open a metal wall, for instance a vault or a door, and for evaluating the given alarm signals. In order to avoid tripping a faulty alarm it is, however, necessary that such systems exclusively respond to the oscillations produced solely by the intrusion attempt, for instance to the vibrations brought about by the breaking open or drilling or any otherwise unauthorized penetration of a protective wall or structure or the sonic oscillations or vibrations produced for instance with an oxyacetylene torch or an oxygen lance during the welding cutting of a metal or concrete wall, not however to external or ambient spurious noises.

It is already known to the art to eliminate the influence of the external spurious noises which are transmitted by the air by sound insulation of the sonic receiver.

In order to eliminate the external spurious noises which are transmitted by the wall or by the structure itself there is exploited the fact that the sonic oscillations produced when there is an intrusion attempt lie in a characteristic frequency range, preferably in the kHz-range near to the upper audio threshold, whereas spurious noises are usually of low frequency. An arrangement operating according to this principle, has been disclosed for instance in U.S. Pat. No. 3,134,970 and employs for the evaluation of the sonic oscillations of spurious noises, received by a piezoelectric receiver, a high-pass filter, thereby eliminating the low-frequency constituents. In order to eliminate briefly lasting spurious noises the output signal of the high-pass filter is integrated, so that an alarm signal is only triggered when there prevails sufficiently long lasting high-frequency sonic oscillations.

To ensure that such systems respond not only to such sonic oscillations, but also to a sudden attack at the region or surface to be protected, for instance by means of an explosive, there is taught to the art an arrangement in U.S. Pat. No. 3,147,467 where there is provided an additional evaluation channel which, upon occurence of very pronounced vibrations of short duration, likewise trips an alarm signal. The threshold value of this additional channel is chosen to be so high that in the presence of an accidental contact with the wall there is still not tripped an alarm signal, but in the presence of hard impact or an explosion attempt there will be immediately tripped an alarm, i.e. only with a slight time delay. Consequently, the susceptibility to disturbances of intrusion reporting arrangements working with sonic receivers is clearly reduced. However, what is disadvantageous with this system design is that with the use of high-pass filters or amplifiers the low-frequency spurious noises, which are better propagated in most walls or structures, can only be poorly segregated from high-frequency oscillations which are predicted upon an intrusion attempt. This leads to the result that weak intrusion vibrations at large distance from the receiver have superimposed thereon spurious noises, so that it is necessary to provide a large number of sonic receivers at a slight spacing from one another in order to afford adequate protection.

From U.S. Pat. No. 3,471,846 there is known to the art an intrusion detection system wherein there is obtained a sharply limited frequency range in that, the feeler signal is mixed with a carrier frequency which periodically continuously passes through a frequency range, and the mixed signal passes through a narrow band filter and is integrated over a number of throughpass periods. The installation indeed allows the elimination of a certain constant oscillation, but however is afflicted with the disadvantage that periodic spurious oscillations, which accidentally lie in the frequency throughpass range, likewise will trigger an alarm and not only the sonic oscillations or vibrations which emanate from an intruder.

SUMMARY OF THE INVENTION

Therefore with the foregoing in mind it is a primary object of the present invention to provide a new and improved method and apparatus for intrusion detection which is not associated with the aforementioned drawbacks and limitations of the prior art proposals.

Another and more specific object of the present invention aims at avoiding the aforementioned drawbacks to heretofore known intrusion detection systems working with acoustical or sonic receivers, and particularly, providing an intrustion detection apparatus which is insensitive to spurious oscillations or vibrations from the surroundings, possesses low probability of tripping false alarms, has better capability of distinguishing external spurious noises from intrusion noises or oscillations, has improved sensitivity, is capable of protecting a surface or area with a smaller number of sonic receivers, is insensitive to singular occuring periodic spurious oscillations, and which can be used throughout the same protective range where there are present spurious sources.

Yet a further significant object of the present invention aims at providing a new and improved method and apparatus for detecting unauthorized intrusions in a highly reliable and accurate manner, is not readily susceptible to influence by spurious noises and is capable of discriminating the same from oscillations caused by an actual intrusion which is to be detected.

A further important object of the present invention aims at a new and improved construction of intrusion detection apparatus which is relatively simple in construction and design, extremely reliable in operation, not readily subject to breakdown or malfunction, requires a minimum of maintenance and servicing, and affords high security against unauthorized intrusions, typically burglaries and other types of unauthorized entry.

Now in order to implement these and still further objects of the invention, which will become more readily apparent as the description proceeds, the intrusion detection method of the present invention generally speaking is of the type wherein the signals delivered by a sonic receiver mounted at a surface or region to be protected, and which signals, if desired, following frequency selective amplification thereof, are admixed with a carrier frequency. The carrier frequency has a frequency which periodically and continuously passes through a predetermined frequency range in a predetermined time duration, and the mixed signals are filtered in a narrow band frequency range. The filtered signals, if desired following conversion into another electrical parameter, are integrated such that the integrated signal is reset when the time spacing of two successive signals exceeds a certain time duration which, at most, is equal to the time duration of a frequency throughpass, and an alarm signal is triggered as soon as the integrated signal, within the reset time, reaches a predetermined threshold.

As mentioned above the invention is not only concerned with the aforementioned method aspects but also pertains to novel apparatus for detecting an intrusion. Such intrusion detection apparatus comprises a sound receiver mounted at the surface to be protected and an electrical evaluation circuit is connected with the sound receiver. The evaluation circuit delivers a signal when the received sonic oscillations exceed predetermined values. The evaluation circuit contains a mixing stage which mixes the signals delivered by the sonic receiver, possibly after such signals have experienced a frequency-selective preamplification, with an oscillation whose carrier frequency periodically and continuously passes through a predetermined frequency range with a predetermined period duration. There is also provided a circuit having a frequency throughpass in a narrow band frequency range for processing the mixed signal. At the output of such circuit there appears the frequency spectrum of the signals in the carrier frequency throughpass range, which signals are transmitted by the sonic receiver. An integrator integrates the output signals of the narrow-band circuit, these output signals, if desired, having been converted to a different electrical parameter. Importantly, the integrator is provided with a reset circuit having a reset time which at most is equal to the carrier frequency throughpass period and there is also provided a threshold value switch for triggering an alarm as soon as the integrated output signal, within the reset time, exceeds a predetermined value.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
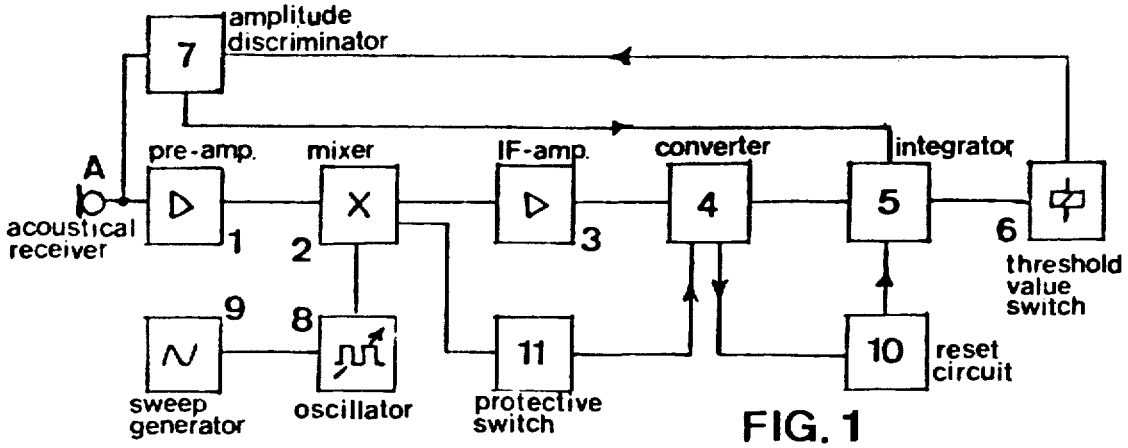
FIG. 1 is a block circuit diagram of an intrusion detection system according to the invention.

Describing now the drawings, with the circuit configuration illustrated in FIG. 1 the output signals of a sonic or acoustical receiver A, a conventional piezoelectric acceleration transducer or pick-up mounted at the surface or wall or other structure which is to be protected against unauthorized intrusions or entry, initially are infed to a bandpass-preamplifier 1. The frequency throughpass range of the preamplifier 1 can lie in the order of, for instance, between 3 and 30 kHz. The output signal is delivered to a mixing stage or mixer 2 which also receives a signal from an oscillator 8. The frequency of this oscillator 8 is periodically and continuously swept in a predetermined frequency range, for instance between 3 and 30 kHz with a throughpass time of, for instance, 3 to 60 seconds. The signal at the output of the mixing stage 2 which is structured, for instance, as a conventional product detector, in other words the difference of the output signal of the bandpass amplifier 1 and the frequency swept oscillator 8, is infed to a narrow band intermediate frequency amplifier 3 which for instance has a band width in the range of 10 to 300 Hz. At the output of this narrow band amplifier 3 there therefore successively appears, during each frequency sweep period, an amplitude signal which corresponds to the momentary frequency position of the oscillator 8, i.e. there appears during each sweep period the entire frequency spectrum of the received sonic oscillations in the evaluation range, for instance between 3 and 30 kHz.

This amplitude spectrum is converted into a different measurement magnitude or parameter by a subsequently circuit connected converter 4, for instance into a current course, a frequency changing analogous with the amplitude or light intensity. The converter 4 may be a voltage controlled transmitter. The output signal of the converter 4 is then infed to an integrator 5 which, depending upon the evaluated magnitude, can be provided with an integration capacitor or a counter. On the other hand, the integrator 5 is controlled by a reset circuit 10 containing a timing element, whose time-constant at most is equal to the throughpass time of a frequency period of the sweep generator 9 or oscillator 8, respectively.

As soon as the signal appears at the output of the narrow band amplifier 3 then the reset circuit 10 and specifically its timing element is placed into operation and after, for instance, 3 to 60 seconds, in the event that there does not appear any new signal, the signal integrated by the integrator 5 again is reset or extinguished. The output signal of the integrator 5, which is infed to a threshold value switch 6, therefore can only reach this threshold if during a single frequency throughpass period the integrated amplitudes have reached this threshold value. This means that a single periodic oscillation is again extinguished before reaching the second throughpass, so that individual periodic oscillations do not summate or add up and can trip an alarm, rather only such vibrations which possess a more or less continuous amplitude spectrum in the evaluated frequency range, and specifically, during an entire frequency througpass, i.e. during a number of seconds, and more precisely, exactly in the evaluated frequency range. Hence, frequencies above or below the frequency band are clearly eliminated.

To prevent sabotage of the intrusion detection apparatus by over controlling or over exciting the employing mixing stage 2, the converter stage or converter 4 is directly controlled with the aid of a protective or protection stage 11 when there are present pronounced, continuously prevailing signals, specifically such that the potential at the integrator 5 only slowly ascends, for instance in 30 seconds.

The described circuit therefore possesses the advantage, in contrast to heretofore known circuits, that the evaluated frequency band is much more sharply limited than would be possible when using a bandpass filter, i.e. low frequency spurious oscillations are not taken into account at all even if they prevail at increased intensity, and periodic oscillations are equally eliminated, so that only irregular oscillations having a more or less continuous frequency spectrum, lasting over a longer time span, lead to alarm tripping.

Additionally, with the described circuit it is possible to provide in conventional manner a second evaluation channel having a higher alarm threshold, by means of which it is possible to evaluate extremely pronounced, briefly lasting vibrations for the purpose of triggering an alarm. This can be accomplished for instance in that at the output of the sonic receiver A there is connected an amplitude discriminator 7 which only has a time delay in the millisecond range and whose output likewise controls the threshold value switch 6 in an OR-circuit. Advantageously, this amplitude discriminator 7 contains a self-holding circuit which, upon response of the threshold value switch 6, automatically is reset. In this way there is beneficially achieved the result that an alarm is tripped not only if there is attempted a slow intrusion, as for instance by breaking the wall or cutting open a vault wall, but equally there is tripped an alarm if there is tried a rapid intrusion attempt, for instance by means of an explosive.

Figure 2:
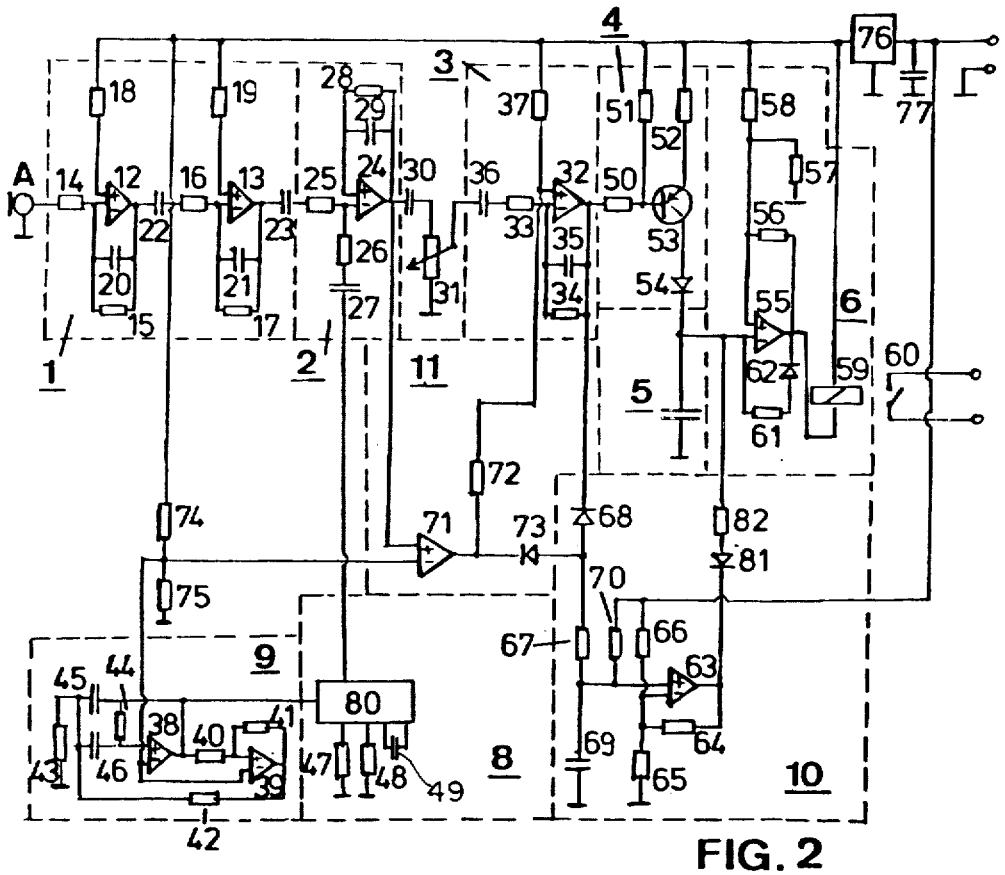
FIG. 2 is a detailed circuit diagram of the arrangement of FIG. 1.

Reverting now to FIG. 2 there are shown details of the circuitry of the arrangement of FIG. 1 for an intrusion detection apparatus according to the invention.

With this circuit configuration the sonic receiver A is connected with a band pass preamplifier 1 consisting of two operational amplifiers 12 and 13 with related feedback resistors 14, 15 and 16, 17, respectively, operating point-setting resistors 18, 19 and capacitors 20, 21 setting the upper band frequency and the capacitors 22, 23 for setting the lower band range. The components are chosen such that there is obtained a throughpass range, for instance, between 3 to 30 kHz.

The following mixing stage 2 consists of an operational amplifier 24 with related coupling resistors 25, 26, the coupling capacitor 27, feedback resistor 28 and capacitor 29 for setting the upper band range. The components are chosen such that there is obtained a frequency throughpass range of, for instance, between 10 to 300 Hz.

This mixing stage 2 is connected by means of a coupling capacitor 30 and a potentiometer 31, serving for sensitivity setting, with the narrow band amplifier 3. This narrow band amplifier 3 likewise contains an operational amplifier 32 with related coupling resistors 33, 34, coupling capacitors 35 and 36 as well as a resistor 37 for setting the operating point. The aforementioned components of the stages 1, 2 and 3, can be combined in a multiple operational amplifier, for instance a commercially available integrated circuit of the type MC 3301 CP, available from the well-known United States firm Motorola Company.

The frequency swept oscillator 8, has its frequency controlled by the sweep generator 9 consisting of two operational amplifiers 38, 39 with related resistors 40, 41, 42, 43, 44 and the capacitors 45, 46. Here also these components can be combined into an integrated circuit, for instance commercially available as type Motorola MC 324 CP.

The sweep oscillator 8 can be constructed, for instance, as an integrated circuit 80 of the commercially available type Motorola MC 14046 CP, the resistors 47, 48 and the capacitor 49 determining the frequencies.

The output signal of the narrow band amplifier 3 is infed to a subsequently connected converter 4 comprising a transistor 53 with coupling resistor 50, base resistor 51 and emitter resistor 52. This converter 4 delivers, as a function of the output voltage of the narrow band amplifier 3, by means of the diode 54 connected with the collector of the transistor 53, an appropriate charging current to the capacitor 5.

Connected with the capacitor 5 is a threshold value switch 6 provided with an operational amplifier 55, which likewise can be integrated into the previously mentioned integrated circuit as the commercially available type Motorola MC 324 CP, and further contains the related resistors or resistances 56, 57 and 58. At the output of the operational amplifier 55 there is connected an alarm relay 59. By means of the work contacts 60 of this alarm relay 59 there is controlled a conventional and therefore not particularly illustrated alarm device. The operational amplifier 55 is shunted by means of a series circuit composed of a resistor 61 and a diode 62, serving for discharging the capacitor 5, in order to obtain a desired alarm self-holding time.

The reset circuit 10 controlling the integrator 5, contains an operational amplifier 63 which is structured as a Schmitt trigger, which likewise can be integrated into the aforementioned integrated circuit of the commercially available type Motorola MC 324 CP, containing the related resistors or resistances 64, 65, 66 and further contains a series circuit of a resistor 67 and a diode 68 for connection with the output of the narrow band amplifier 3 and capacitor 69. This capacitor 69 is discharged by means of the resistor 67 at the diode 68 and is charged by means of the resistor 70.

The protective stage 11, serving for preventing sabotage by over exciting mixing stage 2, will be seen to comprise a operational amplifier 71 and at its output is provided with a resistor 72 and a diode 73. These components are dimensioned such that capacitor 5 is charged relatively slowly, for instance within one half of a minute, through amplifier 32 if the amplifier 71 receives a pronounced continuously prevailing signal from mixing stage 2.

Furthermore, there is provided a voltage divider composed of the resistors 74 and 75, serving for setting the operating point of the sweep generator 9 and the protective circuit 11.

In the connection line for the circuit arrangement there is provided a fixed potential regulator 76, for instance of the commercially available type Motorola MC 7806 CG having a parallely connected capacitor 77, by means of which the supply potential is stabilized through a fixed value.

It is here remarked that there can be utilized in the described circuit configuration also other components having equivalent operation. This will readily suggest themselves to those skilled in the electronics art.

While there are shown and described present preferred embodiments of the invention, it is to be distinctly understood that the invention is not limited thereto, but may be otherwise variously embodied and practiced within the scope of the following claims. accordingly,

What I claim is:

1. A method for detecting an intrusion, comprising the steps of:

obtaining signals delivered by a sonic receiver mounted at the object to be protected;

mixing the obtained signals with a carrier frequency whose frequency periodically and continuously passes within a given time duration through a predetermined frequency range;

filtering the mixed signal in a narrow band frequency range;

upon occurrence of a filtered signal activating a timing circuit having a predetermined time duration;

integrating the filtered signal;

resetting the result of the integrated filtered signal whenever the filtered signals are interrupted for at least said time duration of the timing circuit;

said time duration at most being equal to the time duration of a frequency throughpass; and triggering an alarm signal as soon as the integrated signal reaches a predetermined threshold within the reset time.

2. The method as defined in claim 1, further including the steps of:

frequency selective amplifying the signals delivered by the sonic receiver.

3. The method as defined in claim 1, further including the steps of:

converting the filtered signals into a different electrical parameter.

4. The method as defined in claim 1, wherein:

the predetermined frequency range is obtained by sweeping the carrier frequency in a frequency range in the order of about 3 to 30 kHz.

5. The method as defined in claim 1, wherein:

the mixed signal is filtered in a filter which has a band pass in the order of about 10 to 300 Hz.

6. The method as defined in claim 1, wherein:

the integrated signal is reset after a time duration of between 3 and 60 seconds if there does not appear any further signal.

7. An apparatus for intrusion detection comprising:

sonic receiver means mounted at an object to be protected and receiving sonic oscillations;

an electronic evaluation circuit connected with said sonic receiver means;

said electronic evaluation circuit delivering signals when the received sonic oscillations exceed predetermined values;

said electronic evaluation circuit;

a mixing stage which mixes the signals delivered by the sonic receiver means with a carrier frequency which is periodically and continuously swept through a predetermined frequency range within a predetermined period;

circuit means having a frequency throughpass in a narrow band frequency range for processing the mixed signals;

said circuit means having an output at which there appears the frequency spectrum of the signals in the carrier frequency sweep range which are delivered by the sonic receiver means;

an integrator for integration of the output signals of the narrow band circuit means;

a reset circuit for the integrator having a reset time which at most is equal to the carrier frequency sweep period; and a threshold value switch for triggering an alarm as soon as the integrator output signal exceeds, within the reset time, a predetermined value.

8. The apparatus as defined in claim 7, further including:

preamplifier means for fequency selective amplification of the signals delivered by the sonic receiver means.

9. The apparatus as defined in claim 7, wherein:

said electronic evaluation circuit further includes means connected with said output of said circuit means for converting the output signals of the narrow band circuit means into a predetermined electrical parameter.

10. The apparatus as defined in claim 7, wherein:

said evaluation circuit comprises a sweep generator;

an oscillator controlled by said sweep generator;

said oscillator infeeding to the mixing stage said swept carrier frequency.

11. The apparatus as defined in claim 7, wherein:

said evaluation circuit is provided with a voltage controlled current transmitter connected with said narrow band circuit means having narrow band frequency throughpass characteristics;

said current transmitter having an output; and said integrator comprising a charging capacitor constituting an integration circuit connected with said output.

12. The apparatus as defined in claim 11, wherein:

said evaluation circuit comprises a protective stage controlling said current transmitter such that the potential at the integration capacitor only ascends slowly.

13. The apparatus as defined in claim 7, wherein:

said evaluation circuit contains a further evaluation channel having a higher alarm threshold and shorter time delay for triggering an alarm signal in the presence of extremely pronounced, briefly lasting vibrations.

14. The apparatus as defined in claim 13, wherein:

said additional evaluation channel comprises an amplitude discriminator having a time delay in the range of milliseconds;

said amplitude discriminator having an output; and said output being connected in an OR-circuit configuration with said threshold value switch.

* * * * *